United States Patent [19]

Ogura et al.

[11] Patent Number: 5,055,360

[45] Date of Patent: Oct. 8, 1991

[54] THIN FILM ELECTROLUMINESCENT DEVICE

[75] Inventors: Takashi Ogura, Nara; Takuo Yamashita; Hiroaki Nakaya, both of Tenri; Masaru Yoshida, Nara, all of Japan

[73] Assignee: Sharp Kabushiki Kaisha, Osaka, Japan

[21] Appl. No.: 363,069

[22] Filed: Jun. 8, 1989

[30] Foreign Application Priority Data

Jun. 10, 1988 [JP] Japan ..... 63-143878

[51] Int. Cl.[5] ..... H05B 33/22

[52] U.S. Cl. ..... 428/473.5; 313/509; 428/500; 428/690; 428/917

[58] Field of Search ..... 313/509; 428/690, 917, 428/473.5, 500

[56] References Cited

U.S. PATENT DOCUMENTS

| | | | |
|---|---|---|---|
| 4,560,902 | 12/1985 | Kardon | 313/509 |
| 4,594,282 | 6/1986 | Kawaguchi et al. | 313/509 |
| 4,670,690 | 6/1987 | Ketchpel | 313/509 |
| 4,774,435 | 9/1988 | Levinson | 313/509 |
| 4,882,517 | 11/1989 | Maruyama et al. | 313/509 |

OTHER PUBLICATIONS

Symposium Digest of Technical Papers—"Stable High--Brightness Thin-Film Electroluminescent Panels", Toshio Inoguchi et al, pp. 84–85, Society for Information Display, 1974.

*Primary Examiner*—James J. Seidleck

[57] ABSTRACT

A thin film EL device includes a translucent substrate; a first electrode layer disposed on the upper surface of the translucent substrate; a light emitting layer provided above the first electrode layer. A second electrode layer is provided above the light emitting layer and is electrically connected to the first electrode layer through an applied power source for applying electric field to the light emitting layer. Further one or more insulating layers is provided among the light emitting layer and the first electrode layer and/or the second electrode layer. At least one of the insulating layers is a composite layer of an inorganic film and an organic film and another insulating layer is a composite layer or an inorganic film in which the inorganic film is interposed between the light emitting layer and the organic film.

27 Claims, 2 Drawing Sheets

THIN FILM ELECTROLUMINESCENT DEVICE

BACKGROUND OF THE INVENTION

1. Field of the Invention

The present invention relates to a thin film electroluminescent (EL) device. More particularly, it relates to such a device having a light emitting layer and an insulating layer, which emits EL by applying an electric field.

2. Description of the Prior Art

Conventionally, a thin film EL device has a double-insulating structure in which insulating layers are formed above and below a light emitting layer. It includes a translucent substrate of glass or the like, and a transparent electrode made of $In_2O_3$, $SnO_2$ or the like. It further includes a lower insulating layer made of inorganic material such as $SiO_2$, $Si_3N_4$, $Al_2O_3$, $Ta_2O_5$ or $Y_2O_3$, and a light emitting layer made of host material such as ZnS to which Mn is added as its luminescent center. An upper insulating layer is included which is made of the same material as the lower insulating layer and includes a back electrode layer of Al or the like laminated one after another on the substrate.

Examples of such devices are disclosed in the following U.S. Pat. Nos. 3,967,112; 4,024,389; 4,188,565; 4,389,601; 4,594,282 and 4,727,004. Further, the double-insulating structure has been proposed (see "Symposium Digest of Technical Papers", Society for Information Display, pp. 84–85, 1974).

The material for the upper and lower insulating layers must have a high dielectric strength, high dielectric factors and fewer defects like pin-holes. However, few materials satisfy all the above items. To satisfy them all, generally both the upper and lower insulating layers must include two or more lamination films, respectively.

The above mentioned EL device has advantages of high luminance, long life, low power consumption or the like. However, since the layers of the EL device are, in manufacturing, deposited by a technique such as vapor deposition or a sputtering method which necessitates a vacuum environment. Further, the sputtering method commonly utilized for forming an insulating layer, necessitates a relatively long deposition period to obtain a film of a sufficient thickness. Thus, cost increase is unavoidable.

SUMMARY OF THE INVENTION

Accordingly, it is an object of the present invention to provide a thin film EL device including a translucent substrate; a first electrode layer disposed on the upper surface of the translucent substrate; a light emitting layer provided above the first electrode layer; a second electrode layer provided above the light emitting layer and electrically connected to the first electrode layer through an applied power source for applying electric field to the light emitting layer; and one or more insulating layers provided among the light emitting layer and the first electrode layer and/or the second electrode layer, at least one of the insulating layers being a composite layer of an inorganic film and an organic film and another insulating layer being the composite layer or an inorganic film in which the inorganic film is interposed between the light emitting layer and the organic film.

As described above, in the thin film EL device according to the present invention, one or more insulating layers is provided among the light emitting layer and the first electrode layer and/or the second electrode layer, and at least one of the insulating layers consists of a composite layer of an inorganic film and an organic film. As a result, a necessary period of time for forming the insulating layer can be shortened. Thus, cost reduction can be attained compared to the conventional formation of two or more inorganic lamination films formed by sputtering method, vapor deposition method or the like where a vacuum environment is needed. Further, since the insulating layer, including an organic film, is so disposed that its inorganic film comes in contact with the light emitting layer, luminance is stabilized compared to a device in which an organic film of an insulating layer comes in contact with a light emitting layer, even if the device is worked for long period of time. Thus, according to the present invention, a thin film EL device can be obtained which keeps the same luminance-voltage characteristic as in the above mentioned conventional device having an insulating layer of a lamination of inorganic film alone.

Additionally, when the organic film is made of cyano-lower-alkylated cellulose such as cyanoethyl cellulose having a dielectric constant of 15 to 25, the luminance of the device can be maintained while voltage necessary for the operation is reduced.

DETAILED DESCRIPTION OF THE PREFERRED EMBODIMENT

Figure 1:
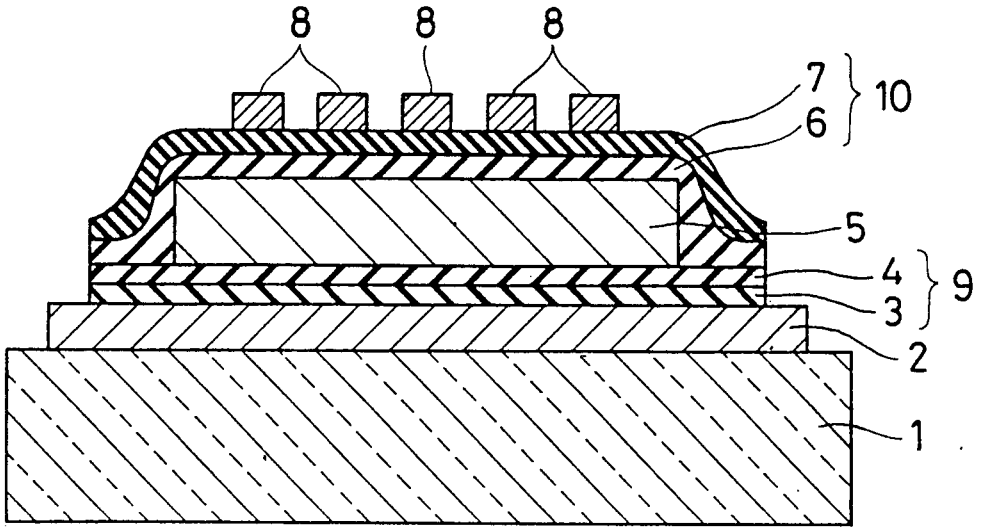
FIG. 1 is a diagram illustrating an embodiment of the present invention.

A thin film EL device according to the present invention is such that emits luminescence when it works by applying voltage between first and second electrode layers and applying electric field to a light emitting layer.

In the thin film EL device, the insulating layer is disposed on at least one of major surfaces of the light emitting layer. The insulating layer consists of a composite layer of an inorganic film and an organic film and the inorganic film comes in contact with the light emitting layer so that the organic film and light emitting layer are isolated from each other.

Preferably, the organic film is, for example, a dielectric thin film made of cyano-lower-alkylated cellulose having a dielectric constant of 15 to 25.

The alkyl group of the cyano-lower-alkylated cellulose has 1 to 5 carbon atoms; for example, methyl, ethyl, propyl and butyl.

The organic film may also be made of a composite resin whose dielectric constant is lower than that of the above stated cyano-lower-alkylated cellulose; for example, vinyl resin, polystyrene, polyethylene, acrylic resin, epoxy resin and polyimide resin. Each thin film made of these resins preferably has a dielectric constant of 10 or lower.

The organic film is deposited by a film formation technology such as a known spinning method, roll coating method, screen printing method or the like which necessitates no high vacuum environment.

In order to deposit a cyanoethyl cellulose film having the thickness of 1000 to 3000 Å by means of spinning method, for example, the following steps are carried out. Thus, the steps of depositing an $Si_3N_4$ film (inorganic film) on one of the major surfaces of a light emitting layer, subjecting it to spinning of 2000 to 5000 r.p.m. by a spinner with 1 to 10% solution of cyanoethyl cellulose dissolved in solvent of dimethylformamide, and drying it in an atmospheric environment for 30 to 60 minutes at 100° to 300° C. The drying may be promoted in a vacuum environment of approximately 1 Torr. A vacuum of 1 Torr can be realized without difficulty as compared with a vacuum environment of approximately $10^{-5}$ to $10^{-6}$ Torr, which is necessary for depositing an inorganic film such as $Si_3N_4$, $SiO_2$, $Al_2O_3$, $Ta_2O_3$ or $Y_2O_3$ film, or the like by a known technique of sputtering or vapor deposition. In addition to that, the sputtering and vapor deposition methods take relatively long period of time in depositing a film and, consequently, cost increase is unavoidable. In accordance with the above method, the organic film can be deposited with a desired film thickness for an insulating layer with lower cost than the inorganic film. This is because there is no need of practicing larger numbers of processing steps including a step in a vacuum environment.

A double insulating structure is employed in the thin film EL device of the present invention, where a lower insulating layer is formed by depositing an $SiO_2$ film of 200 to 500 Å thickness and an $Si_3N_4$ film of 1500 to 2500 Å thickness above a substrate, one after another, and an upper insulating layer is formed by depositing an $Si_3N_4$ film of 200 to 1500 Å thickness and a cyanoethyl cellulose film of 1000 to 2000 Å thickness on an upper major surface of an light emitting layer one after another. Thus, the light emitting layer is interposed between the lower and upper insulating layers.

Also, an insulating layer of organic and inorganic films may be disposed on one surface of the light emitting layer instead of the above-mentioned double insulating structure.

In the above double insulating structure, also, the upper and lower insulating layers may be formed with respective inorganic films being interposed between respective organic films and the light emitting layer.

Each insulating layer may be formed of three or more laminated films instead of two if the following requirements for the insulating layer are satisfied; (i) high dielectric strength, (ii) high dielectric constant, and (iii) fewer defects such as a pin-hole.

Referring to FIG. 1, the thin film EL device of the present invention includes a glass substrate 1, a transparent electrode 2 disposed on an upper major surface of the substrate 1, a light emitting layer 5 and back electrode 8 disposed above the substrate 1, a lower insulating layer 9 interposed between the light emitting layer 5 and the transparent electrode 2 and an upper insulating layer 10 interposed between the light emitting layer 5 and back electrode 8. The upper insulating layer 10 consists of an $Si_3N_4$ film 6 adjacent to the light emitting layer 5 and a cyanoethyl cellulose film 7 disposed thereon, and the lower insulating layer 9 consists of an $SiO_2$ film 3 disposed on the transparent electrode 2 and an $Si_3N_4$ film 4 adjacent to the light emitting layer 5.

A method for manufacturing the thin film EL device of the present invention will now be described. The transparent electrode (ITO film) 2 is deposited on the glass substrate 1 with the thickness of approximately 2000 Å by means of sputtering and is partially etched away into strips. Then, the $SiO_2$ film 3 and $Si_3N_4$ film 4 are deposited in 2000 to 2500 Å thickness by sputtering to form the lower insulating layer 9. The light emitting layer 5, in which ZnS is used as a host material and Mn is provided as a luminescent center, is deposited on the lower insulating layer 9 in approximately 7000 Å thickness by electron beam evaporation. The $Si_3N_4$ film 6 is deposited thereon in the thickness of approximately 200 to 1500 Å as a part of the upper insulating layer 10. Then, 1 to 10% solution of cyanoethyl cellulose is dissolved in solvent of dimethyl formamide and is applied thereto by spinning of 2000 to 5000 r.p.m. by a spinner and a drying treatment in an atmospheric environment for 30 to 60 minutes at 100° to 300° C. is performed to form the cyanoethyl cellulose film 7 of 1000 to 2000 Å thickness. The back electrode 8 of Al are formed into stripes perpendicular to the transparent electrode 2, and thus the thin film EL device is finished.

Figure 3:
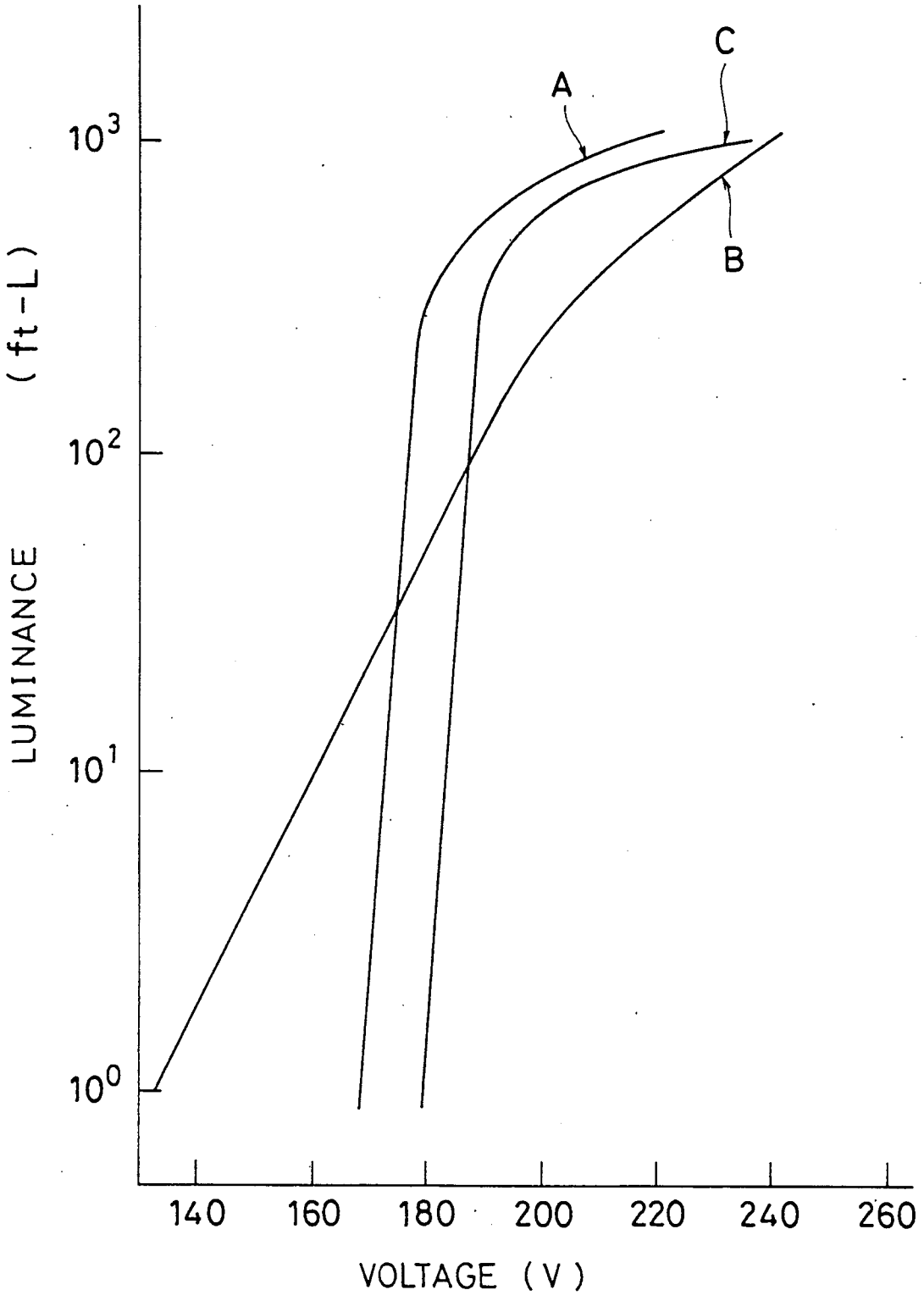
FIG. 3 is a graph illustrating luminance - voltage characteristics of the above embodiments and a prior art embodiment.

Referring to FIG. 3, an example of the luminance-voltage characteristic of the device is represented in a curve A. It should be noted that the luminance-voltage characteristic of the device of the present invention is the same as that of a conventional device represented in a curve C.

Figure 2:
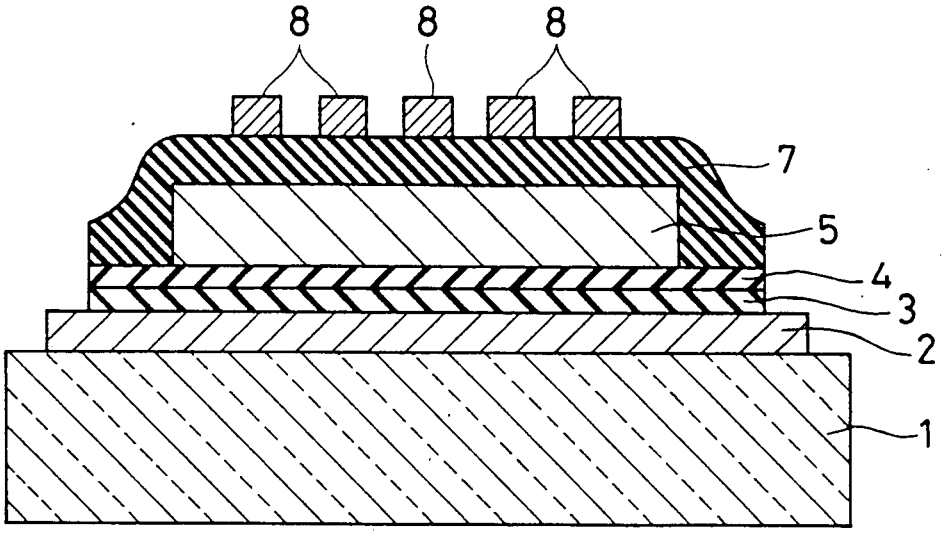
FIG. 2 is a diagram illustrating an embodiment presented for the comparison with the embodiment of the present invention.

As shown in FIG. 2, the upper insulating layer may be formed of the cyanoethyl cellulose film 7 alone. In this case, however, working the device over a long period of time results in its slow rising as shown in a curve B. This is apt to increase consumed electric power.

In this embodiment, the inorganic $Si_3N_4$ films 6, 4 are disposed on the upper and lower surfaces of the light emitting layer 5. Further, the organic cyanoethyl cellulose film 7 is disposed on the upper $Si_3N_4$ film by spinning, so that a thin film EL device which keeps the same characteristic as in the conventional EL device and is manufactured at a low cost, can be obtained.

As has been described, according to the present invention, a thin film EL device has an insulating layer which is deposited on at least one of the upper and lower surfaces of the light emitting layer. The insulating layer is formed of organic and inorganic layer portions made of organic and inorganic materials, respectively. The organic layer portion is deposited by a spinning method, roll coating method or the like. At least one inorganic layer is interposed between an organic layer and the light emitting layer. Consequently, the thin film EL device of the present invention keeps the same characteristics as in the conventional device which has an insulating layer formed of an inorganic layer portion alone. Further, it requires a shortened manufacturing time and a reduced manufacturing cost.

It is not intended to be exhaustive or to limit the present invention to the precise form disclosed. Obviously, many modifications and variations will be apparent to those who are skilled in the art.

What is claimed is:

1. A thin film EL device, comprising:

translucent substrate;

first electrode layer disposed on the upper surface of said translucent substrate;

first insulating layer disposed on said first electrode layer;

light emitting layer disposed on said first insulating layer;

second insulating layer disposed on said light emitting layer; and second electrode layer disposed on said second insulating layer and electrically connected to said first electrode layer through an applied power source for receiving voltage and applying an electric field to said light emitting layer;

said, second insulating layer being a composite layer including an inorganic film and an organic film, said inorganic film being interposed between said light emitting layer and said organic film to thereby maintain luminance of said light emitting layer and said organic film being interposed between said second electrode layer and said inorganic film to reduce voltage necessary to produce said electric field.

2. The device of claim 1 wherein said first insulating layer is an inorganic film layer, the inorganic film layer including two different inorganic films.

3. The device of claim 1 wherein said organic film is made of an organic material by means of one of spinning, roll coating, and screen printing.

4. The device of claim 1 wherein the organic film is a cyano-lower-alkylated cellulose.

5. The device of claim 4, wherein said cyano-lower-alkylated cellulose is cyanoethyl cellulose.

6. The device of claim 1 wherein said inorganic film is one of an $SiO_2$ and an $SI_3N_4$ film.

7. The device of claim 1 wherein said inorganic film, when existing as a non-composite insulating layer is made of $SiO_2$ and $Si_3N_4$.

8. The device of claim 1 wherein said organic film is a thin dielectric film having a dielectric constant of 15 to 25.

9. The device of claim 1 wherein said organic film is a thin dielectric film having a dielectric constant not greater than 10.

10. The device of claim 1 wherein said organic film is made of one of polystyrene, polyethylene, acrylic resin, epoxy resin and polyimide resin.

11. The device of claim 1 wherein said first insulating layer is a composite layer including an inorganic film and an organic film, said inorganic film being interposed between said light emitting layer and said organic film.

12. The device of claim 11, wherein each of the organic films, in each of the first and second insulating layers, is a cyano-lower-alkylated cellulose.

13. The device of claim 12, wherein said cyano-lower-alkylated cellulose is cyanoethyl cellulose.

14. The device of claim 11, wherein each of the inorganic films, in each of the first and second insulating layers, is one of an $SiO_2$ and an $Si_3N_4$ film.

15. The device of claim 11, wherein each of the organic films, in each of the first and second insulating layers, is a thin dielectric film having a dielectric constant of 15 to 25.

16. An electroluminescent device, comprising:

a substrate;

first electrode layer disposed on said substrate;

first insulating layer disposed on said first electrode layer;

light emitting layer disposed on said first insulating layer;

second insulating layer disposed on said light emitting layer; and second electrode layer disposed on said second insulating layer;

said first and second insulating layers being composite layers formed of an inorganic film insulating and disposed on said light emitting layer and an organic film disposed on said inorganic film.

17. The device of claim 16, wherein said light emitting layer is an electroluminescent layer.

18. The device of claim 16, wherein said first and second organic films of said first and second insulating layers are disposed in contact with said first and second electrode layers, respectively.

19. The device of claim 16 wherein said first electrode layer includes a plurality of parallel electrodes disposed in a first direction and said second electrode layer includes a plurality of parallel electrodes disposed in a second direction, perpendicular to said first direction.

20. The device of claim 19 wherein said first and second electrode layers are electrically connected and that when a voltage is applied to said first and second electrode layers, an electric field is produced to light said light emitting layer.

21. The device of claim 20, wherein said first and second organic films of said first and second insulating layers are disposed in contact with said first and second electrode layers, respectively, to thereby reduce the voltage applied which is necessary to produce said electric field.

22. The device of claim 16 wherein each organic film is a cyano-lower-alkylated cellulose.

23. The device of claim 22, wherein the cyano-lower-alkylated cellulose is cyanoethyl cellulose.

24. The device of claim 16 wherein each inorganic film is one of an $SiO_2$ and an $Si_3N_4$ film.

25. The device of claim 16 wherein each organic film is a thin dielectric film having a dielectric constant of 15 to 25.

26. The device of claim 16 wherein each organic film is a thin dielectric film having a dielectric constant of not greater than 10.

27. The device of claim 16 wherein each organic film is made of one of polystyrene, polyethylene, acrylic resin, epoxy resin and polyimide resin.

* * * * *